US007662251B2

(12) United States Patent
Salama et al.

(10) Patent No.: US 7,662,251 B2
(45) Date of Patent: Feb. 16, 2010

(54) METHOD OF MANUFACTURING COMPOSITE RISER

(75) Inventors: Mamdouh M. Salama, Richmond, TX (US); Brian E. Spencer, Sacramento, CA (US)

(73) Assignee: ConocoPhillips Company, Houston, TX (US)

( * ) Notice: Subject to any disclaimer, the term of this patent is extended or adjusted under 35 U.S.C. 154(b) by 638 days.

(21) Appl. No.: 11/413,449

(22) Filed: Apr. 28, 2006

(65) Prior Publication Data

US 2006/0188342 A1 Aug. 24, 2006

Related U.S. Application Data

(62) Division of application No. 10/288,710, filed on Nov. 5, 2002, now abandoned.

(51) Int. Cl.
*B65H 81/00* (2006.01)

(52) U.S. Cl. ..... 156/169; 156/172

(58) Field of Classification Search ..... 156/169, 156/172, 173, 175
See application file for complete search history.

(56) References Cited

U.S. PATENT DOCUMENTS

| | | | |
|---|---|---|---|
| 2,139,745 | A | 12/1938 | Goodall |
| 2,661,225 | A | 12/1953 | Lyon |
| 2,812,025 | A | 11/1957 | Teague et al. |
| 3,477,506 | A | 11/1969 | Malone |
| 3,489,220 | A | 1/1970 | Kinley |
| 3,529,853 | A | 9/1970 | Triest et al. |
| 3,768,842 | A | 10/1973 | Ahlstone |
| 4,290,836 | A | 9/1981 | McPherson et al. |
| 4,449,281 | A | 5/1984 | Yoshida et al. |
| 4,501,327 | A | 2/1985 | Retz |
| 4,589,801 | A | 5/1986 | Salama |
| 4,634,314 | A | 1/1987 | Pierce |
| 4,728,224 | A | 3/1988 | Salama et al. |
| 4,745,977 | A | 5/1988 | Love et al. |
| 4,875,717 | A | 10/1989 | Policelli |
| 5,097,585 | A | 3/1992 | Klemm |
| 5,105,854 | A | 4/1992 | Cole et al. |

(Continued)

FOREIGN PATENT DOCUMENTS

| | | |
|---|---|---|
| CA | 2320028 | 3/2001 |

(Continued)

OTHER PUBLICATIONS

Johnson, D. , et al, "Composite Choke and Kill Lines", Offshore Technology Conference, May 6-9, 2002.*

(Continued)

*Primary Examiner*—Jeff H Aftergut

(57) ABSTRACT

A method of manufacturing a composite riser section with a liner assembly comprises holding the liner assembly in a horizontal position, bowing the liner assembly upward, and winding resin impregnated fibers about the liner assembly to form a structural composite overwrap. Another method of manufacturing a composite riser with a liner assembly comprises holding the liner assembly in a horizontal position between two supports, and winding resin impregnated fibers about the liner assembly to form a structural composite overwrap. A system for manufacturing a composite riser section with a liner assembly having a longitudinal axis comprises a first support and a second support that hold the liner assembly in a horizontal position therebetween, and a plurality of rollers that rotate the liner assembly about the longitudinal axis.

11 Claims, 4 Drawing Sheets

U.S. PATENT DOCUMENTS

| | | | |
|---|---|---|---|
| 5,185,215 | A | 2/1993 | Adams, Jr. et al. |
| 5,233,737 | A | 8/1993 | Policelli |
| 5,348,095 | A | 9/1994 | Worrall et al. |
| 5,398,975 | A | 3/1995 | Simmons |
| 5,474,132 | A | 12/1995 | Gallagher |
| 5,483,894 | A | 1/1996 | Facciano et al. |
| 5,487,411 | A | 1/1996 | Goncalves |
| 5,725,026 | A | 3/1998 | Maimets |
| 5,785,120 | A | 7/1998 | Smalley et al. |
| 5,813,467 | A | 9/1998 | Anderson et al. |
| 5,944,124 | A | 8/1999 | Pomerleau et al. |
| 5,988,300 | A | 11/1999 | Pomerleau et al. |
| 6,042,152 | A | 3/2000 | Baldwin et al. |
| 6,050,612 | A | 4/2000 | Wolterman |
| 6,250,385 | B1 | 6/2001 | Montaron |
| 6,405,762 | B1 | 6/2002 | Bunch |
| 6,457,532 | B1 | 10/2002 | Simpson |
| 6,561,227 | B2 | 5/2003 | Cook et al. |
| 2001/0045289 | A1 | 11/2001 | Cook et al. |
| 2003/0047939 | A1 | 3/2003 | Whitehead et al. |

FOREIGN PATENT DOCUMENTS

| | | | | |
|---|---|---|---|---|
| EP | 0 907 049 | A2 | | 4/1999 |
| JP | 61-68233 | A | * | 4/1986 |
| JP | 1-257012 | A | * | 10/1989 |
| WO | WO 2004/044371 | A1 | | 5/2004 |
| WO | WO 2004/044372 | A1 | | 5/2004 |

OTHER PUBLICATIONS

Spencer, Brian E., "Composite End Fitting Designs," Addax, Inc., 4 pgs.

Spencer, Brian E., "Application of the Filament Winding Process," Advanced Composites: The Latest Developments—Proceedings of the Second Conference on Advanced Composites, Dearborn, Michigan, Nov. 18-20, 1986, ASM International, cover + pp. 106-116 (11 pgs.).

Spencer, Brian E., "The Design and Application of High Performance Filament-Wound Composites," OMAE Symposium, Houston, Texas, Mar. 2, 1987, 6 pgs.

"Design, Manufacturing, and Pricing Information for Composite Production Risers," Oct. 3, 1990, pp. 1-18.

Salama, Mamdouh M., et al., "Composite Introduction Riser —Testing and Qualification," SPE Production & Facilities, Aug. 1998, pp. 169-177 (9 pgs.).

Salama, Mamdouh M., et al., "Design Consideration for Composite Drilling Riser," OTC 11006, Offshore Technology Conference, Houston, Texas, May 3-6, 1999, pp. 1-11.

Silverman, Seth, "Drilling and production riser business poised to grow"; Lightweight Risers, Hart's E&P, Nov. 1999; pp. 87-90 (2 pgs.).

Salama, Mamdouh M., "Application and Remaining Challenges of Advanced Composites for Water Depth Sensitive Systems," Deep Offshore Technology 2000, 12th Annual Deep Offshore Technology Int. Conference, New Orleans, Louisiana, Nov. 7-9, 2000, 8 pgs.

"World's First Composite Riser Tested Offshore," Kvaerner Network News, Sep. 12, 2001, 2 pgs.

"Proposal for Genesis Composite Production Riser and Demonstration: CompRiser," Chevron Petroleum Technology Company, Sep. 20, 2001, pp. 1-31.

Salama, Mamdouh M., et al., "Composite Risers Are Ready for Field Applications—Status of Technology, Field Demonstration and Life Cycle Economics," 13th International Deep Offshore Technology Conference (DOT 2001), Rio de Janeiro, Brazil, Oct. 17-19, 2001, pp. 1-18.

"Composite riser, tether could cut TLP displacement by 10,000 t," Norway: XP-001123833, Offshore, Apr. 2002, p. 108.

Saad, Pascinthe, et al., "Application of Composites to Deepwater Top Tensioned Riser Systems," OMAE 2002-28325, 21st International Conference on Offshore Mechanics and Arctic Engineering, Oslo, Norway, Jun. 23-28, 2002, pp. 1-7.

International Search Report, PCT/US 03/34578, Mar. 16, 2004, 3 pgs.

International Search Report, PCT/US 03/34618, Mar. 31, 2004, 7 pgs.

"The Case for Composites," Surveyor, Spring 2005, pp. 8-12.

* cited by examiner

METHOD OF MANUFACTURING COMPOSITE RISER

CROSS-REFERENCE TO RELATED APPLICATIONS

This is a Divisional Application of U.S. patent application Ser. No. 10/288,710 filed Nov. 5, 2002, now abandoned, and entitled "Metal Lined Composite Riser in Offshore Applications". This application is also related to commonly owned U.S. patent application Ser. No. 10/288,709, filed Nov. 5, 2002 and entitled "Replaceable Liner For Metal Lined Composite Risers In Offshore Applications." Both applications are hereby incorporated by reference herein in their entirety.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to metal lined composite risers and methods of manufacturing composite riser assemblies of this type. More particularly, the present invention relates to a metal lined composite riser section featuring a metal-to-composite interface (MCI) having a plurality of structural composite overwrap layers attached to a metal liner assembly using traplock fittings.

BACKGROUND

As offshore exploration and production of oil and gas has moved into deeper water, it has become increasingly important to reduce weight, lower costs, and improve reliability of water-depth sensitive systems such as risers and the like. The term riser generally describes various types of pipes or conduits that extend from the seabed toward the surface of the water. By way of example only, these conduits may be used as drilling risers, production risers, workover risers, catenary risers, production tubing, choke and kill lines, and mud return lines. Conventional risers are normally constructed of various metal alloys such as titanium or steel. More recently, however, the oil and gas industry has considered a variety of alternative riser materials and manufacturing techniques including the use of composite materials.

Composite materials offer a unique set of physical properties including high specific strength and stiffness, resistance to corrosion, high thermal insulation, dampening of vibrations, and excellent fatigue performance. By utilizing these and other inherent physical characteristics of composite materials, it is believed that composite risers may be used to lower system costs and increase reliability of risers used in deep water applications. Although there has been a significant effort in the last decade to facilitate and to increase the general use of composites in offshore applications, the acceptance of composite materials by offshore operators continues to be a relatively slow and gradual process. Reasonably good progress has been made to expand the usage of composites for topside components such as vessels, piping and grating. Some advanced components such as high-pressure riser accumulator bottles have already been used successfully in the field. However, in view of the reduced weight, extended life span, lower cost and other enabling capabilities, composite risers are particularly appealing for deep water drilling and production operations.

Composite risers are generally constructed of a series of joints or sections each having an inner metal liner assembly and a number of structural composite overwrap layers which enclose the metal liner assembly. Typically, a metal liner assembly comprises a thin tubular metal liner, usually of titanium or steel, coaxially secured to a metal connector assembly. The connector assembly includes both a metal-to-composite interface (MCI) and a transition ring. The metal liner is secured to the MCI and the connector assembly through the transition ring. The transition ring can be machined as an integral part of the connector assembly or made separately and then welded to the connector assembly. The connector assembly is a standardized interface at the end of each riser section which facilitates the attachment of one riser section to the next in series using flanges, threaded fasteners or the like. The metal liner and the connector assemblies at each end are then usually enclosed within an elastomeric shear ply, followed by a composite overwrap reinforcement to form a composite riser section. The composite riser section is then heated to cure the elastomeric shear ply and the composite overwrap. The elastomeric shear ply allows a small amount of relative movement between the metal liner assembly and the composite overwrap to accommodate for differences in coefficients of thermal expansion and elastic modulus. An external elastomeric jacket and a further composite overwrap may also be provided over the composite riser section and thermally cured to provide additional impact protection and abrasion resistance in an attempt to limit external damage to the composite riser section.

In application, the metal liner assembly functions to prevent leakage due to the inherent cracking characteristics of the composite material itself. Over time, the matrix in the composite material will tend to develop micro cracks at pressures lower than those at which the composite fibers themselves will fail. The matrix micro cracking is due to the thermal stresses induced by the curing cycle and the mechanical stresses induced during the shop acceptance pressure test of the composite riser section during the manufacturing process. Thus, although the metal liner assembly does not provide a great deal of mechanical strength to the riser, it functions to assure the fluid tightness of the composite riser and to prevent the leakage under conditions of matrix cracking which are inevitable.

The composite overwrap is secured to the metal liner assembly through the metal-to-composite interface (MCI). A traplock MCI may be used to mechanically lock a number of helical (axial) composite plys into a series of annular grooves with several hoop (circumferential) plys of the composite forcing the helical plys downward into the grooves. Accordingly, there is a need for a metal lined composite riser which can offer the benefits of high strength and reduced weight, which has been designed to provide greater field reliability through the use of a traplock MCI that will ensure that the composite material remains firmly adhered to the metal liner assembly throughout the useable lifetime of the riser.

SUMMARY

The present invention provides a metal lined composite riser section for use in offshore applications featuring a traplock MCI to secure a plurality of structural composite overwrap layers about the metal liner assembly. It is believed that a metal lined composite riser constructed of sections according to the present invention will offer outstanding strength to weight characteristics, durability and leak resistance and provide a useable lifetime which is comparable to that of existing titanium and steel risers used in offshore applications.

According to the present invention, a metal liner assembly of the composite riser section will be provided with a traplock metal-to-composite interface (MCI) at each end. This traplock MCI may be incorporated into the connector assembly which is welded or attached to a commercially available metal liner through a transition ring. Each traplock is formed with at least one annular groove or channel which has been made in the exterior surface of the metal liner assembly. As will be discussed herein, these annular trap grooves may be of various geometries and may be arranged adjacent to each other to form a traplock having 2 to 8 grooves to ensure adequate load transfer capacity between the composite overwrap and the metal liner assembly.

The metal lined composite riser section of the present application typically comprises a metal liner assembly having a traplock MCI, an elastomeric shear ply disposed about the metal liner assembly, and a plurality of structural composite overwrap layers which are disposed about the shear ply and held in place by the traplock MCI. The metal liner assembly is formed of a metal liner as known in the art, such as carbon steel, stainless steel or titanium liner, and is usually fitted at each end with a connector assembly through a transition ring. The connector assemblies have a series of annular grooves which are cut into the exterior surface of the assembly and disposed side-by-side to form a traplock. The transition rings are welded to the connector assemblies to permit a smooth load transfer between the thin liner and the thick connector assembly and to allow the use of different materials for the liner and the connector assembly. The connector assemblies permit sections of composite riser to be mated together, in series, using flanges, threaded fasteners or the like. The elastomeric shear ply is usually formed of a rubber like material, such as Hydrogenated Acrylonitrile Butadiene Rubber (HNBR), and completely covers the liner and the connector assemblies of the metal liner assembly. This shear ply is then further secured in place by at least one layer of hoop windings of composite fiber which are placed at an angle almost perpendicular to the longitudinal axis of the metal liner assembly. By way of example only, suggested hoop windings may be wound at about plus or minus 80° to the longitudinal axis of the assembly.

A number of structural composite overwrap layers are then secured about the assembly to create a composite riser section according to the present invention. These overwrap layers may be built up of alternating helical and hoop fiber windings to form a composite material. Alternatively, a number of the helical windings may be supplemented, substituted or eliminated by sheets of prepreg composite material which is then secured in place by the hoop windings. The helical windings or prepreg layers are intended to receive the axial loading of the composite riser section and to provide tensile strength in most applications. The hoop windings serve to provide resistance to hoop stresses induced by internal pressure and, of at least equal importance, also serve to secure the helical windings or prepreg plys and ensure that they do not become detached from or slip relative to the metal lining assembly.

The traplock MCI comprises at least one, and usually about 2 to 8, grooves or traps which are cut about the circumference of the metal liner assembly near each end. By way of example only, a prepared metal liner assembly enclosed within a shear ply may be wound with a helical ply at plus or minus 10° relative to the longitudinal axis of the riser section. A substantially perpendicular hoop winding may then be placed about the helical winding at plus or minus 80°. The hoop winding binds the helical winding and forces it downward into the groove of the traplock. In one embodiment of the present invention, alternating helical and hoop layers or plys may be built up in pairs and grouped into sets of three for each groove of the traplock MCI. Thus, by way of example only, a composite riser section constructed in accordance with the present invention may comprise traplocks having six grooves at each end of the metal liner assembly and the composite layers may be wound such that alternating helical and hoop layers are secured with the first set of six layers held by the first groove of the traplock, closest to the middle of the composite riser section, the next set of six layers held by the second groove of the traplock, and so forth until the final set of six layers are held by the sixth groove of the traplock and all 36 layers (18 pairs) are firmly secured to the metal liner assembly to form a composite riser section. As noted earlier, it is also possible to substitute sheets of prepreg composite material by wrapping the liner in 0° prepreg in place of the helical layers having plus and minus 10° windings. This 0° prepreg handles the axial loading of the composite riser section, and is secured in place by the hoop windings much like the helical windings which the prepreg is used in place of.

It should be understood that the traplock MCI may have any number of grooves or traps as long as there is at least one proximate to each end of the metal liner assembly. The number of traps and the total number of structural composite overwrap layers may be varied depending upon the actual loading conditions of the composite riser section and its intended end use application. Similarly, the wind angles of the overwrap helical and hoop layers may be varied and the pattern in which they are laid up may also be changed so that a number of helical windings may be bound in place by a single hoop layer, rather than always alternating from helical to hoop in pairs. Again, the number of hoop windings required need be only sufficient to withstand the hoop stresses applied to the composite riser section and to secure the helical or axial load bearing layers about the metal liner assembly. Once the structural composite overwrap layers have been wound or laid up about the metal liner assembly, it is necessary to apply heat to cure the composite material to complete the construction of the composite riser section. It is also possible to further enclose this entire composite riser section within an additional elastomeric layer, such as HNBR, and apply non-structural composite overwraps to act as an external jacket and to provide further protection from impact and abrasion damage which may occur as the riser section is put into use in the field.

It is further within the scope of the present invention to provide a method of making composite riser sections of the type set forth and described herein. This may be done by providing a metal liner assembly having a traplock MCI and enclosing this metal liner assembly within an elastomeric shear ply. The metal liner assembly may then be mounted to a mandrel to support the liner assembly or counterweighted to facilitate the composite fiber winding process by preventing the excessive bending and torsional deformation in the thin metal liner due to the weight of the uncured composite. The support system must also allow for the free rotation of the liner assembly during the filament winding and curing process to prevent sag in the composite laminate while still uncured. As noted earlier, the composite fibers are typically applied in alternating pairs of helical and hoop plys, which may be gathered into sets of three and bound into the trap grooves of the MCI starting with the grooves closest to the middle of the riser section and working outwardly toward the ends of the riser section. As a result, the first three pairs of composite layers are overwrapped by the second three pairs of composite layers and so forth until the final three pairs overwrap all of the previous ones. Thus, it is possible to apply a great deal of pressure, particularly to the innermost layers of the composite overwrap and hold them securely in place within the trap grooves of the MCI. Following the winding or lay up steps, the entire composite wrapped metal liner assembly is placed into an oven and cured. Next, the elastomeric external jacket may be applied, an additional hoop winding may be used to further secure the external jacket, and non-structural composite plys may be added. Finally, the entire assembly is placed into an oven and cured a second time to complete the composite riser section according to the present invention.

Disclosed herein is a method of manufacturing a composite riser section with a liner assembly comprising holding the liner assembly in a horizontal position, bowing the liner assembly upward, and winding resin impregnated fibers about the liner assembly to form a structural composite overwrap. In an embodiment, the method further comprises disposing the liner assembly between two supports. The liner assembly may be held in the horizontal position without inserting a mandrel into the liner assembly. The method may further comprise laying up at least one prepreg ply when forming the structural composite overwrap. In an embodiment, the method further comprises laying up strips of uncured rubber material to form an elastomeric shear ply about the liner assembly prior to winding the resin impregnated fibers. The method may further comprise applying sufficient heat to cure the elastomeric shear ply and the structural composite overwrap. In an embodiment, the method further comprises laying-up strips of uncured rubber material to enclose the structural composite overwrap in an external jacket, winding resin impregnated fibers over the external jacket to form a scuff-resistant protective layer, and applying sufficient heat to cure the external jacket and the scuff-resistant protective layer. In another aspect, a composite riser section is manufactured according to the method disclosed herein. In an embodiment, the liner assembly is formed of metal selected from the group consisting of titanium, steel, stainless steel and combinations thereof.

Further disclosed herein is a method of manufacturing a composite riser with a liner assembly comprising holding the liner assembly in a horizontal position between two supports, and winding resin impregnated fibers about the liner assembly to form a structural composite overwrap. In an embodiment, the method further comprises positioning the two supports a distance apart that is less than a total relaxed length of the liner assembly. The method may further comprise applying weight to the two supports. In an embodiment, winding resin impregnated fibers about the liner assembly comprises rotating the liner assembly about a longitudinal axis of the liner assembly. The method may further comprise preventing lateral movement of the liner assembly while rotating the liner assembly.

Also disclosed herein is a system for manufacturing a composite riser section with a liner assembly having a longitudinal axis comprising a first support and a second support that hold the liner assembly in a horizontal position therebetween, and a plurality of rollers that rotate the liner assembly about the longitudinal axis. In various embodiments, the first support and the second support are spaced a distance apart that places the liner assembly in an upwardly bowed position, and/or the first support and the second support are weighted sufficiently to maintain the liner assembly in the upwardly bowed position during manufacturing. The system may further comprise a first plug inserted into one end of the liner assembly; and a second plug inserted into an opposite end of the liner assembly. In an embodiment, the plurality of rollers comprises a first pair of rollers engaging the one end and the opposite end of the liner assembly respectively; and a second pair of rollers engaging the first plug and the second plug respectively.

BRIEF DESCRIPTION OF THE DRAWINGS

The present invention will be better understood in view of the detailed description in conjunction with the following drawings in which like reference numbers refer to like parts in each of the figures, and in which.

DETAILED DESCRIPTION

Figure 1:
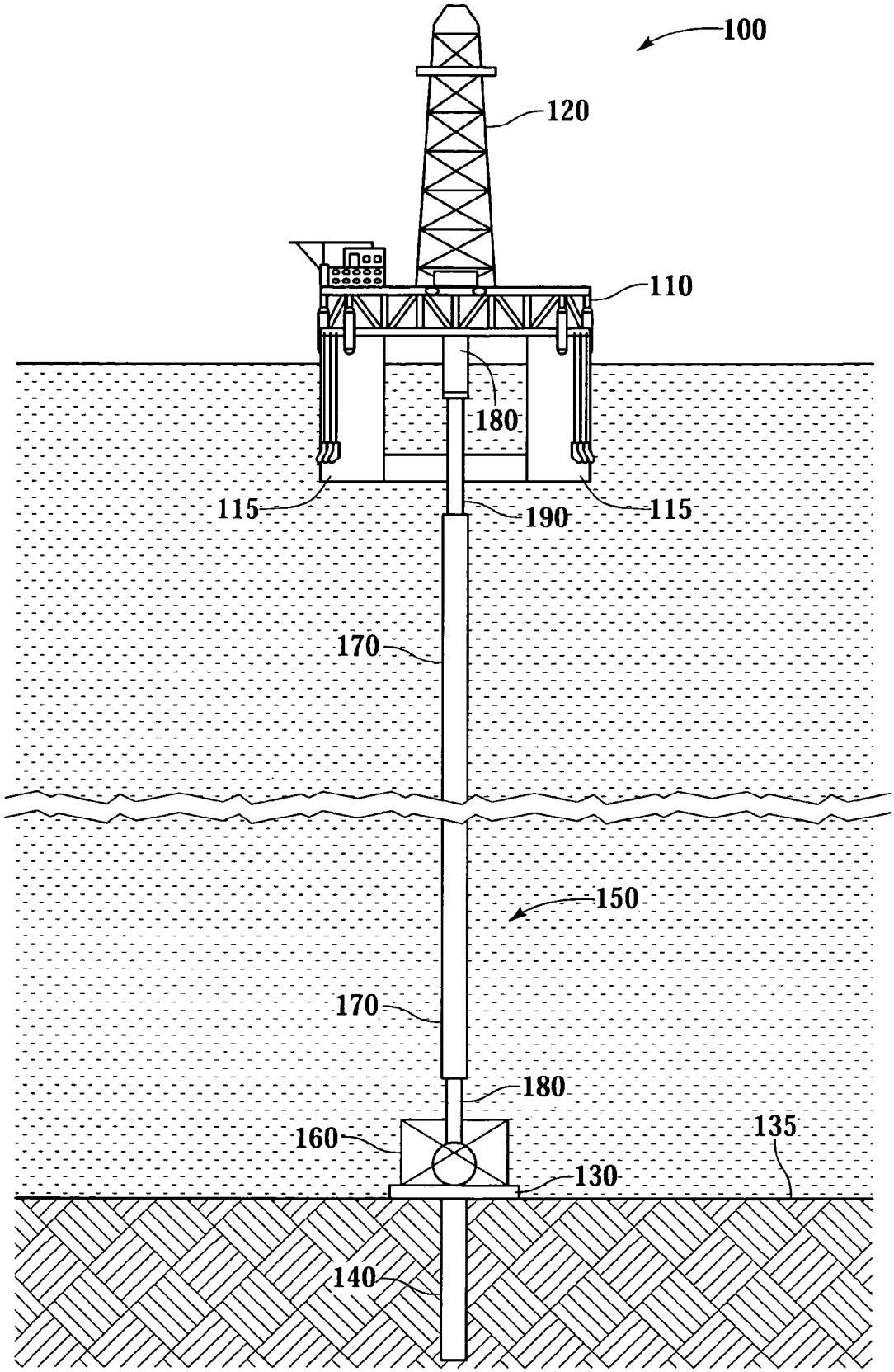
FIG. 1 is an elevational view of a simplified schematic illustrating the use of risers in an offshore drilling and production assembly.

FIG. 1 is a simplified schematic of a conventional offshore drilling and production assembly [100] which illustrates the context of the present invention. An offshore platform [110] supports a derrick [120] which is a conventional apparatus for drilling or working over a borehole and producing hydrocarbons from the borehole. The offshore platform [110] is, in turn, further supported by pontoons [115]. A subsea template [130] is provided on the seafloor [135] and a borehole [140] extends downwardly therefrom into the earth.

An elongated riser assembly [150] extends between the subsea template [130] and the platform [110], providing for fluid communication therebetween. The riser assembly [150] also generally comprises a tieback connector [160] proximate to the subsea template [130] and a number of riser sections [170] which extend between the platform [110] and the subsea template [130 ] and are connected thereto by a taper or flex joint [180] and a telescoping section [190]. The flex joint [180] and the telescoping section [190] are designed to accommodate the movement of platform [110] relative to the subsea template [130] and the borehole [140]. The composite riser joints or sections [170] that comprise the riser assembly [150] are coaxially secured together by threaded fasteners or other mechanical fastening devices, as known in the art. Each riser section [170] must accommodate the pressure of the fluid or gas within the section, the tensile load which is caused by suspension of additional riser sections below that section, and the tensile loads and bending movements which are imposed by the relative motion of the platform [110] with respect to the subsea template [130].

In a composite riser section according to the present invention, metal connectors are coaxially secured to a metal liner to form a metal liner assembly which is subsequently wrapped with an elastomeric shear ply, a number of structural composite overwrap layers, and an external elastomeric jacket providing additional impact and abrasion resistance. The composite overwrap further comprises a number of individual layers, which are applied about the metal liner assembly at various angles relative to the longitudinal axis of the composite riser section. Each of these layers or plys is wound or applied one at a time and consist of a number of small diameter fibers (e.g., from about 6 to about 10 microns) having high specific strength and modulus properties which are embedded in a polymer matrix material.

The polymer matrix material, usually some form of resin or glue, has bonded interfaces which capture the desirable physical characteristics of both the embedded fibers and the matrix itself. In short, the fibers carry the main loads which may be applied to the composite material while the matrix maintains the fibers in the preferred orientation. The matrix also acts to transfer loads across large numbers of fibers and to protect the fibers from the surrounding environment. The resulting composite material properties depend upon both major components, the fibers and the polymeric matrix. A number of known thermosetting or thermoplastic polymeric matrixes may be used to produce the composite riser section in accordance with the present invention. For the composite riser section of the present invention, preferred matrix materials may include various vinyl esters and epoxies with glass transition temperatures above about 270° F. By way of example, one preferred resin is EPON 862 (available from Resolution Performance Products of Houston, Tex.) amine-cured epoxy formulated with an additional hardener and curing agent. Although it is not a structural concern, the components of the resin are preferably selected to avoid suspected carcinogenic compounds, particularly MDA curing agents.

A number of fiber types may be used for forming suitable overwrap layers on the composite riser section. Fibers are usually graded according to the tensile modulus as measured in millions of pounds per square inch (msi). One type of preferred fiber is a low cost, medium modulus (about 32 msi to about 44 msi, and preferably 35 msi) polyacrylinitrile (PAN) carbon fiber. Several acceptable fibers of this type are HEXEL AS4D-GP, available from Hexel Corp. of Stamford, Conn.; GRAFIL 34-700, available from Grafil of Sacramento, Calif.; and TORAY T700SC (LMS-R10544), available from Toray of Tokyo, Japan. Another type of preferred fiber is a high modulus (about 55 to about 80 msi, and preferably about 55 msi) PAN carbon fiber in either tow form or uniaxial prepreg mats. Acceptable grades of this fiber include PYROFIL 56-700, available from Grafil; and TORAY M40J, available from Toray. Alternatively, a hybrid of glass and carbon fibers incorporated into the matrix material may also provide acceptable results. One preferred form of glass fiber is commonly known as E-glass fiber, available commercially as PPG 1062-430, available form PPG of Pittsburgh, Pa.; and OWENS-CORNING 30-158B-450, available form Owens-Corning of Toledo, Ohio.

Figure 2:
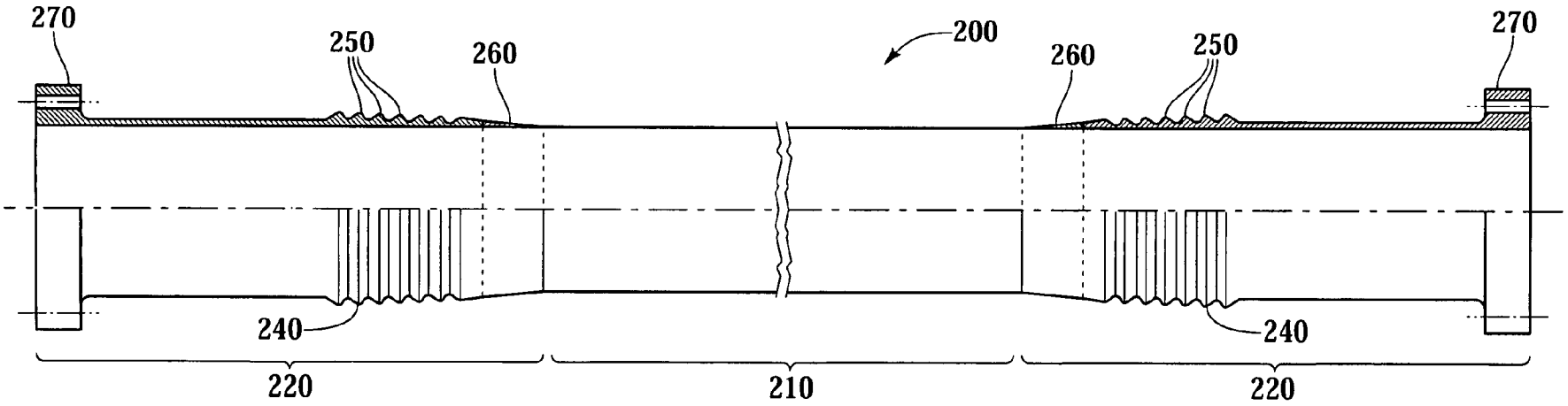
FIG. 2 is a cross sectional view of a metal liner assembly for a composite riser section constructed in accordance with the present invention.

FIG. 2 shows a metal liner assembly [200] suitable for manufacturing a composite riser section which comprises a tubular liner [210] and connector assemblies [220] attached at opposite ends. The tubular liner [210] may be formed of titanium, steel, or other metal alloys suitable for offshore oil and gas production applications. In some instances, it may be desirable to incorporate additional corrosion resistance by using a stainless steel liner [210].

Still referring to FIG. 2, in accordance with the present invention, the connector assembly [220] of the composite riser section features a traplock MCI [240] and is welded or affixed to a transition ring [260] located between the MCI [240] and the liner [210]. The MCI [240] further comprises a number of trap grooves [250] for securing a structural composite overwrap, not shown here. As shown here, the mechanical connector [270] is usually formed of titanium, steel or the like and is welded to the connector assembly [220] to provide a number of fittings for mechanically fastening the composite riser sections together in series to form a riser assembly between the seafloor and the production platform. It should be understood that although the metal liner assembly [200] shown in FIG. 2 is formed of at least seven separate components (i.e., a liner [210], two transition rings [260], two MCIs [240], and two mechanical connectors [270]) which are subsequently welded together to form a single assembly [200], it would be possible to fabricate a metal liner assembly from three tubular sections (i.e., a liner [210 ] and two connector assemblies [220] that each include a transition ring, an MCI and a flange machined from a single piece of tubing) to create a metal liner assembly [200].

Figure 3:
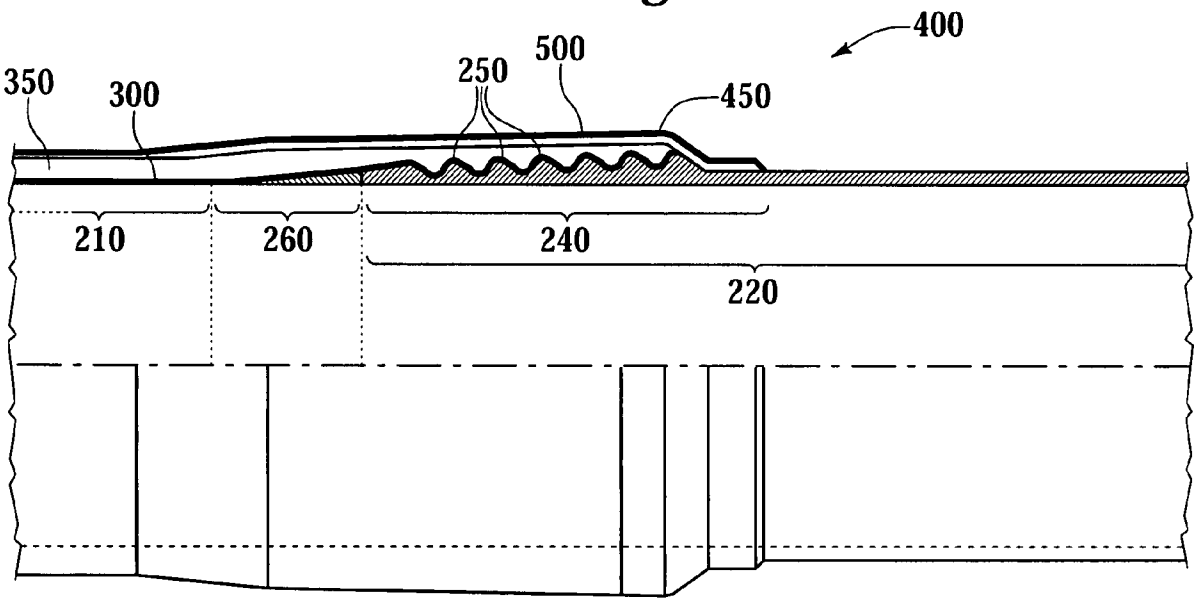
FIG. 3 is a detailed drawing of a cross sectional view of the traplock metal-to-composite interface portion of a metal lined composite riser section constructed in accordance with the present invention.

FIG. 3 shows a detailed partial cutaway of a composite riser section [400] constructed in accordance with the present invention. Note that each connector assembly [220] further comprises a traplock MCI [240] having a plurality of outer grooves [250] which are shown here. Although a series of six trap grooves [250] are shown disposed sided-by-side, the number of grooves can vary as appropriate for the intended end use of the riser section [400]. Additionally, the trap grooves [250] may take a number of different configurations in that they may be cut at about 90° to the surface of the metal liner assembly [200] and may have sidewalls which are cut at right angles to form a square channel or alternatively may have sidewalls which are angled inward to form a trapezoidal groove. The sidewall angle of the grooves normally ranges from about 30 to about 60 degrees and may differ on opposing sidewalls. The trap grooves [250] may also be cut to different depths to create a stepped arrangement, as shown. Regardless of the geometry, each groove [250] acts as a mechanical interlock joint which is fabricated into the outer surface of the MCI [240].

An elastomeric shear ply [300] in an uncured state is typically applied to the outer surface of the metal liner assembly [200] of FIG. 2 to provide for a high shear strain capacity to accommodate small amounts of movement between the composite overwrap [350] and the metal liner assembly [200] because of differences in the thermal expansion coefficient and the elastic modulus. One preferred elastomeric shear ply [300] is formed of Hydrogenated Acrylonitrile Butadiene Rubber (HNBR) and is bonded using CHEMLOK 205 primer and CHEMLOK 238 adhesive to the liner and part of the connection assemblies [220] outboard of the traplock MCI [240]. The elastomeric shear ply [300] can have any suitable thickness, and the thickness can vary at particular regions of the metal liner assembly [200] to achieve desired characteristics. By way of example only, the thickness of one preferred elastomeric shear ply [300] may be about 0.09 inches over the entire length of the liner portion [210] of the metal liner assembly [200], while the shear ply [300] thickness may be reduced to about 0.01 inches over the grooves [250] of the traplock MCI [240]. The reduced thickness of the shear ply [300] in the grooves [250] allows the bearing surfaces in the traplock joint to move without damage to the structural composite overwrap [350] and improves the bearing performance of the composite riser section [400].

The structural composite overwrap [350] is a composite tube comprising carbon, glass or other reinforcing fibers embedded in an epoxy matrix, as previously described herein, which is fabricated over the metal liner assembly [200] using built-up layers via a filament winding process. Generally, the composite overwrap [350] is wound over the elastomeric shear ply [300] which has been applied to metal liner assembly [200], as described hereinabove. The composite overwrap [350] includes helical layers that extend in a generally axial direction along the metal liner assembly [200] from end to end and hoop layers that are applied substantially perpendicular to the helical layers about the circumference of the metal liner assembly [200]. The helical fiber layers of the composite and the elastomeric shear ply [300] are compacted into the trap grooves [250] of the MCI [240] and are held securely in place by the hoop windings of the composite overwrap [350].

The filament winding process for fabricating the composite overwrap [350] over the metal liner assembly [200] is generally described as follows. Composite overwrap [350] comprises alternating helical and hoop layers of fiber, including an initial consolidating hoop layer which is wound over the elastomeric shear ply [300]. After winding each of the fiber and matrix helical layers, the helical layer is compacted into a trap groove [250] with hoop windings. In this manner, a number of subsequent helical layers are also compacted into each of the trap grooves [250]. Localized reinforcing layers of fiber and matrix, preferably a prepreg material, may also be applied over MCI [240] and compacted into each of the trap grooves [250] to improve the load sharing across the grooves [250] and to increase the strength of the MCI [240]. By way of example only, the thickness of the individual helical and hoop fiber layers may be about 0.015 inches to about 0.050 inches. A final layer of hoop windings is wound over the entire length of the metal liner assembly [200], including MCI [240], thereby completing the filament winding of composite overwrap [350]. Other filament winding processes recognized in the art may be suitable for fabricating the composite riser section of the present invention.

Various strength characteristics and other mechanical properties of the composite riser section [400] may be adjusted by varying the wind angle of the composite overwrap [350]. It is possible to make useful riser sections having helical or axial load bearing plys ranging from about 0° to about plus or minus 20° to the longitudinal axis of the riser section. Likewise, the hoop plys should generally lay nearly perpendicular to the underlying helical ply and range from about 90° to about plus or minus 70° to the longitudinal axis of the riser section [400]. Using conventional fiber winding techniques, however, it is preferable to have a helical winding angle of at least about plus or minus 5° and corresponding hoop winding angle of not less than about plus or minus 85°. In place of one or more helical or hoop layers, 0° prepreg plys may be laid-up at 0° and 90°, but these plys will require additional hoop windings to compress the prepreg into the MCI [240] and ensure that is conforms to the metal liner assembly [210].

By way of example only, one preferred embodiment of the present invention is a composite riser section having 6 MCI trap grooves at each end and 36 total layers of structural windings about the metal riser assembly. For this riser section, a Grade 9 titanium liner assembly is prepared with a HNBR shear ply and a 55 msi hoop winding to form an initial consolidating hoop layer across the entire length. A carbon fiber (33 msi) helical layer is then applied at a 10° wind angle followed by a hybrid (55 msi) hoop layer at −80°. The next pair of structural plys is applied at −10° and 80°, the following pair is applied at 10° and −80°, and so forth. For every three pairs of windings a new MCI trap groove is started, working from the innermost groove, nearest the middle of the riser section, outward until all six traps are filled.

Optionally, it is possible to further reinforce the traplock [240] region and spread the applied loads more evenly across all of the trap grooves [250] by further incorporating a 0° carbon prepeg (55 msi) layer after the second and third helical winding layer for each trap groove [250]. Similar riser sections [400] may be produced having at least 1 trap groove [250] at each end of the riser section [400] with about 1 or more pairs of windings per groove [250]. It may also be desirable or cost effective to apply two or more helical windings to the liner [200] before each hoop winding. Obviously, a nearly infinite number of winding variations may be used as limited only by the designer's imagination and the structural loading requirements of a particular application.

After the filament winding is complete, the wound assembly is transferred to an oven, not shown, or heating elements are placed about the composite assembly where heat is applied to cure the thermosetting matrix of the composite overwrap [350] and the elastomeric shear ply [300]. After curing, an external jacket [450] of uncured elastomeric material, such as HNBR, may be applied over the entire length of the resulting composite riser section [400] to prevent migration of seawater into the composite wall and through its interface with the MCI [240]. The external elastomeric jacket [450] provides additional impact protection, mitigating possible damage caused by dropped tools or mishandling of the composite riser section [400]. An additional composite layer [500] of E-glass or other reinforcing fibers such as carbon in a polymeric matrix may be filament wound over the external elastomeric jacket [450] to further compact the jacket [450] during the cure and to provide additional scuff protection. The composite riser section [400] is then heated a second time to a suitable temperature to cure the elastomeric external jacket [450] and composite outerwrap [500].

In the manufacture of a composite riser section the metal liner assembly must be held in a horizontal position but allowed to rotate about its axis to facilitate fiber spinning. Of course the composite overwrap layers have a significant amount of weight, particularly during fiber spinning in which the matrix resin material is still wet. The composite overwrap will cause an unsupported metal liner assembly to flex or bow in the middle during manufacture. This would result in a very poorly constructed composite riser section that would almost certainly be too curved for use. Composite risers are generally constructed using a steel mandrel which is inserted trough the liner assembly to support the weight of the composite overwrap during the fiber winding process. After the composite overwrap has cured, the mandrel is removed and the riser section is ready for use. However, because the metal liner is normally very thin walled, usually 2-4 mm thick, and because the composite overwrap will tend to bow the riser section in the middle, the process of removing the steel mandrel from the completed riser section may cut or gouge the metal liner. In some cases, the metal liner is so badly damaged that a new composite riser section must be scrapped entirely. Accordingly, a method of making composite riser sections without inserting a mandrel would be desirable and could significantly improve manufacturing efficiency by reducing scrapped parts.

Figure 4:
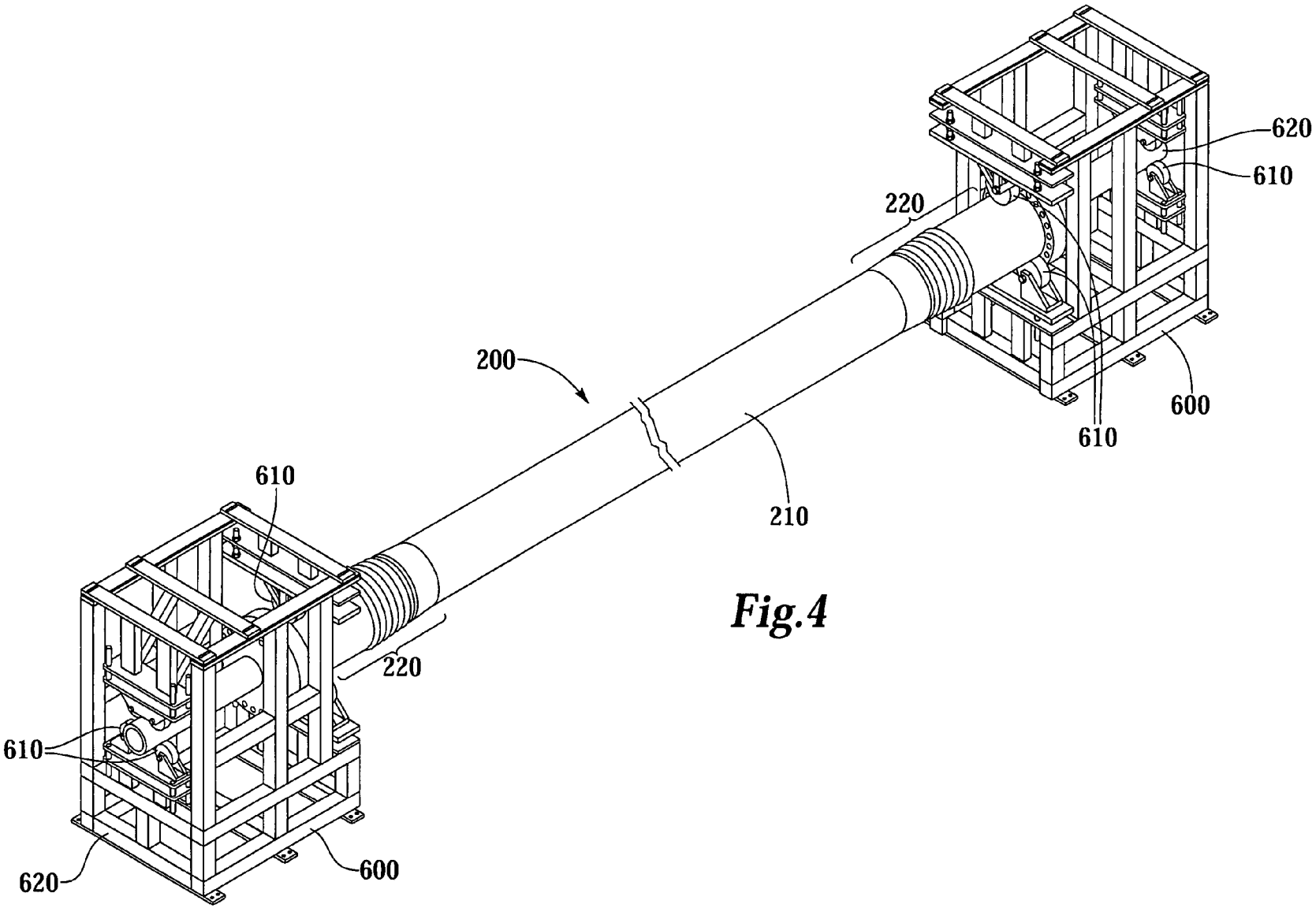
FIG. 4 is a perspective view of a counterweight system for holding the composite riser during assembly without a mandrel.

Referring now to FIG. 4, a perspective drawing of a counterweight system for use in assembling composite risers without a mandrel is shown. The composite riser is constructed by holding a metal liner assembly in a horizontal position and then winding fiber about the exterior surface. As shown here, a metal liner assembly [200] is held in a horizontal position between two supports [600] having a number of rollers [610] which permit the liner assembly [200] to rotate freely about its longitudinal axis. The liner assembly [200] is further secured by two short mandrels or plugs [620] inserted into the bore of the liner assembly [200] at opposite ends. The plugs [620] have an outer diameter that is slightly less than the inner diameter of the liner assembly [200] and are designed to extend into connection assembly [220] but not into the liner [210] itself. The plugs [620] may also extend outward from the liner assembly [200] to create leverage by interaction with the rollers [610] of the supports [600].

During the manufacturing process, the liner assembly [200] is fitted with a plug [620] at each end and placed in the supports [600]. The rollers are then clamped into place about the connection assembly [220] and the extended portion of the plugs [620] to ensure that the only movement permitted is about the longitudinal axis. The supports [600] are set at a distance apart that is slightly less than the total relaxed length of the liner assembly [200]. Thus, the liner assembly [200] should be bowed slightly upward in the middle prior to winding the composite overwrap, not shown. The supports must be weighted sufficiently to hold the liner in this bowed condition. As the composite material is applied to the liner assembly [200], the weight of the composite will exert force upon the liner assembly [200] and cause it to straighten out or flatten in the middle. The liner assembly [200] must be checked during fiber winding to ensure that it is not permitted to sag. The supports [600] may be pushed slightly closer together during this process, if needed.

Figure 5:
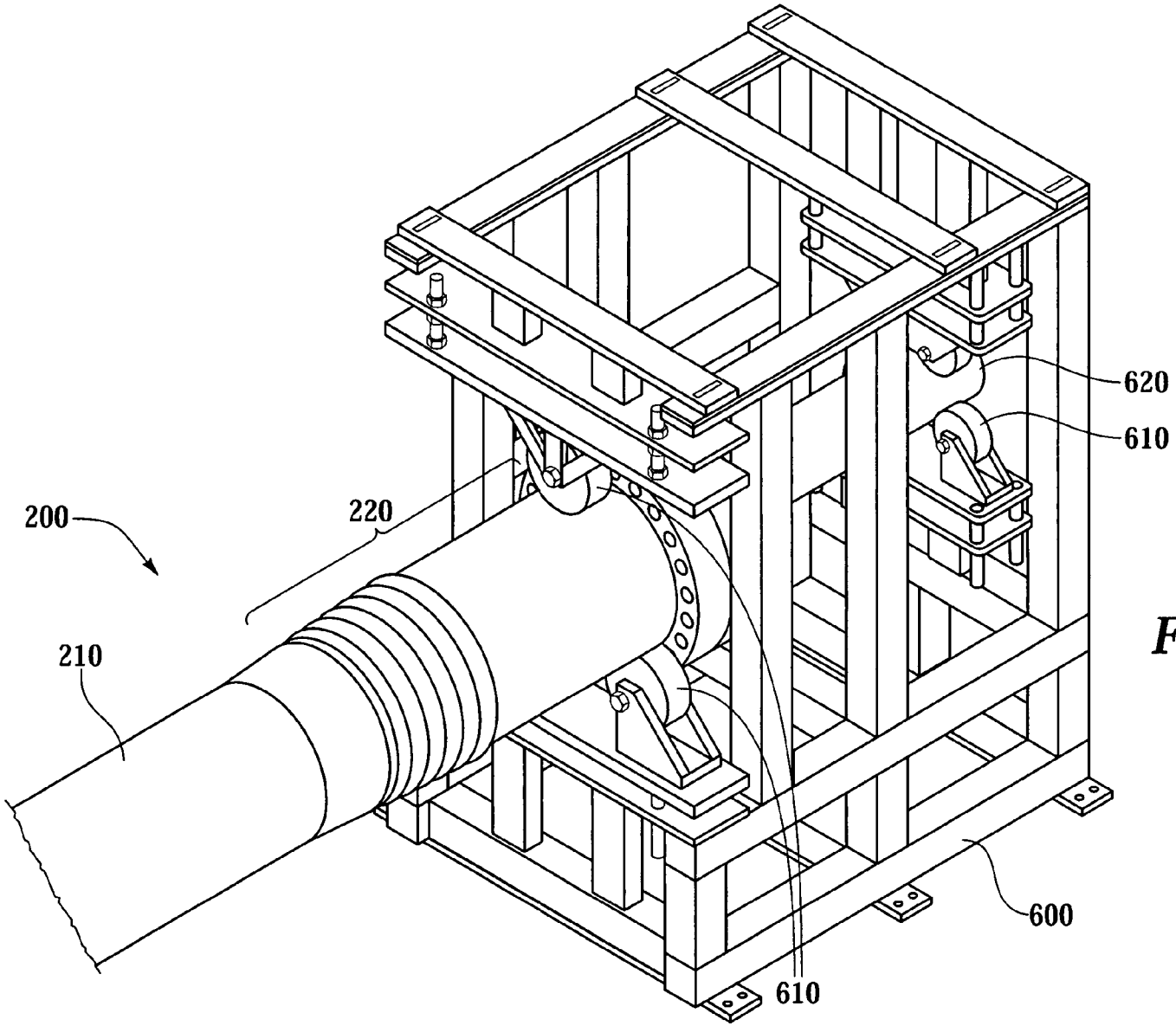
FIG. 5 is a detailed perspective view of a counterweight system for holding the composite riser during assembly without a mandrel.

As best seen in FIG. 5, a detailed perspective drawing of the counterweight system illustrates the manner in which a composite riser is held horizontally and rotated to facilitate fiber spinning. As shown here, the support [600] is constructed of steel plates or angles, but could be manufactured of other materials and then weighted to avoid movement during fiber winding. It is also shown that a first pair of rollers [610] is in contact with the connection assembly [220] and that a second pair of rollers [610] is in contact with the plug [620]. As noted earlier, the rollers [610] hold the liner assembly [200] securely in place to prevent lateral movement but allow the liner assembly [200] to rotate about its longitudinal axis. Of course, while two pairs of rollers [610] are shown here for supporting the liner assembly [200], it is understood that a variety of roller arrangements may be used and the exact number or positioning may be altered as long as the liner assembly [200] is not free to move laterally, is free to rotate about its axis, and is bowed slightly upward in the middle prior to fiber winding.

The use of metal lined composite risers should provide significant benefits once these risers are produced on a commercial scale. Preliminary investigations and cost analysis has revealed that composite risers constructed in accordance with the present invention offer reduced weight, improved vibration dampening, improved thermal insulation, and substantial cost savings. In regard to weight, for a typical 22 inch diameter riser section, the metal lined composite riser section should be about ⅔ of the weight of a titanium riser section and about ½ of the weight of a steel riser section. Concerning fabrication, the composite riser section should cost about 1-1½ times the cost of a steel riser section and only ½ the cost of a titanium riser section. Although the composite riser section will cost a bit more than the steel riser section, it is important to note that it usually costs about $4-7 per pound of topside weight on an offshore facility. By decreasing the weight of the riser section to ½ that of steel, the additional fabrication cost will be more than offset. Moreover, the reduced weight of the composite riser section will make it easier to handle and require less power to move thereby reducing wear and tear on the existing drilling platform machinery.

As noted earlier, composite risers also offer improved thermal insulation. This too is of greater importance as water depth increases. Many conventional risers require heating to maintain the desired fluid viscosities within the riser. This may be both difficult and somewhat expensive. By way of comparison, the thermal conductivity of a typical steel riser may be compared to that of a composite riser. Water has a thermal conductivity of about 0.6 W/m-C, a steel riser has a thermal conductivity of about 50 W/m-C, and a composite riser has a thermal conductivity of about 0.5 W/m-C. As might be expected, the steel riser has a very high thermal conductivity and transfers heat from inside the riser to the surrounding seawater at a very high rate. In contrast, the composite riser almost matches the thermal conductivity of the surrounding water. Moreover, if heating were required, heating elements could be incorporated into the composite overwrap layers during fabrication of the composite riser.

Another property of composite risers is improved dampening characteristics. If exploited fully in drilling risers, the dampening characteristics may reduce or eliminate the need for strakes commonly used to suppress vortex induced vibrations. Preliminary test data has indicated that composite risers offer a structural dampening which is nearly equivalent in value to conventional hydrodynamic dampening. Additionally, higher dampening composite risers may be produced by tailoring the laminate structure, i.e. introducing interleaf layers, to maximize this particular property.

Additional background information regarding composite drilling risers is disclosed in each of the following articles which are incorporated by reference herein in their entirety: Composite Risers are Ready for Field Applications—Status of Technology, Field Demonstration and Life Cycle Economics, 13$^{th}$ International Deep Offshore Technology Conference (DOT 2001), Rio de Janeiro, Brazil, Oct. 17-19, 2001: Remaining Challenges of Advanced Composites for water depth sensitive systems, presented at the 2$^{nd}$ Annual Deep Offshore Technology Int. Conf. Held in New Orleans, La. on Nov. 7-9, 2000; OTC 11006: Design Consideration for Composite Drilling Riser, presented at the Offshore Technology Conference held in Houston, Tex. on May 3-6, 1999; SPE 50971: Composite Production Riser Testing and Qualification, SPE Production & Facilities, August 1998 (p. 168-178). These papers also present a considerable amount of economic cost data for comparison of various composite structures for offshore applications relative to conventional steel ones.

While a preferred embodiment of the invention has been shown and described herein, modifications thereof may be made by one skilled in the art without departing from the spirit and the teachings of the invention. The embodiments described herein are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalence of the subject matter of the claims.

What we claim as our invention is:

1. A method of manufacturing a composite riser section with a liner assembly comprising:

holding the liner assembly in a horizontal position;

bowing the liner assembly upward; and winding resin impregnated fibers about the liner assembly to form a structural composite overwrap.

2. The method of claim 1 further comprising disposing the liner assembly between two supports.

3. The method of claim 1 wherein the liner assembly is held in a horizontal position without inserting a mandrel into the liner assembly.

4. The method of claim 1 further comprising laying up strips of uncured rubber material to form an elastomeric shear ply about the liner assembly prior to winding the resin impregnated fibers.

5. The method of claim 4 further comprising applying sufficient heat to cure the elastomeric shear ply and the structural composite overwrap.

6. The method of claim 5 further comprising:

laying-up strips of uncured rubber material to enclose the structural composite overwrap in an external jacket;

winding resin impregnated fibers over the external jacket to form a scuff-resistant protective layer; and applying sufficient heat to cure the external jacket and the scuff-resistant protective layer.

7. The method of claim 1 further comprising laying up at least one prepreg ply when forming the structural composite overwrap.

8. A method of manufacturing a composite riser with a liner assembly comprising:

holding the liner assembly in a horizontal position between two supports;

winding resin impregnated fibers about the liner assembly to form a structural composite overwrap; and positioning the two supports a distance apart that is less than a total relaxed length of the liner assembly to bow the liner assembly upward.

9. The method of claim 8 further comprising applying weight to the two supports.

10. The method of claim 8 wherein winding resin impregnated fibers about the liner assembly comprises rotating the liner assembly about a longitudinal axis of the liner assembly.

11. The method of claim 10 further comprising preventing lateral movement of the liner assembly while rotating the liner assembly.

* * * * *